US005870987A

United States Patent [19]

Ikeya et al.

[11] Patent Number: 5,870,987

[45] Date of Patent: Feb. 16, 1999

[54] AIR INTAKE DEVICE FOR OUTBOARD BOAT ENGINE

[75] Inventors: Toshiaki Ikeya; Mitsuhiko Ohta; Naoki Kawasaki, all of Shizuoka-Ken, Japan

[73] Assignee: Suzuki Motor Corporation, Shizuoka-Ken, Japan

[21] Appl. No.: 841,671

[22] Filed: Apr. 30, 1997

[30] Foreign Application Priority Data

May 2, 1996 [JP] Japan ..... 8-111537

[51] Int. Cl.[6] ..... F02M 35/10

[52] U.S. Cl. ..... 123/184.24; 123/184.34; 123/184.47

[58] Field of Search ..... 123/184.24, 184.34, 123/184.47, 196 W

[56] References Cited

U.S. PATENT DOCUMENTS 3,783,845 1/1974 Brandstetter ..... 123/184.34
5,357,913 10/1994 Okumura et al. ..... 123/184.34
5,630,390 5/1997 Tsunoda et al. ..... 123/184.34
5,651,338 7/1997 Pacheco et al. ..... 123/184.34
5,713,771 2/1998 Takahashi et al. ..... 123/184.34

*Primary Examiner*—Marguerite McMahon
*Attorney, Agent, or Firm*—Finnegan, Henderson, Farabow, Garrett & Dunner, L.L.P.

[57] ABSTRACT

An air intake device for a vertically oriented multi-cylinder outboard boat engine having an engine block, a crankcase, and vertically spaced fuel intake ports. The air intake device includes a surge tank rigidly attached to the crankcase and having a plurality of vertically spaced air intake union pipes extending from the surge tank, and an intake manifold cover rigidly attached to the engine block and having a plurality of vertically spaced air intake union pipes extending from the intake manifold cover. A flexible air intake hose is connected between the air intake union pipes extending from the surge tank and the air intake pipes extending from the intake manifold cover.

8 Claims, 4 Drawing Sheets

AIR INTAKE DEVICE FOR OUTBOARD BOAT ENGINE

BACKGROUND OF THE INVENTION

1. Field of Invention

This invention relates to an outboard boat engine air intake device. More particularly, this invention relates to an air intake device that easily attaches to a boat engine.

2. Description of Related Art

Many outboard boat motors include a multi-cylinder engine in which the crank shaft is vertically oriented. Recently, fuel injection air intake devices have become widely used in engines of this type.

Fuel injection air intake devices used in vertically oriented multi-cylinder engines include a surge tank that regulates the air flow, as well as air intake pipes that extend substantially horizontally in multiple vertical stages from the surge tank to the respective intake ports of the engine and fuel injectors that inject fuel into the intake ports. Also, the surge tank has a throttle valve that regulates the amount of air that is taken in.

When the throttle valve opens, fresh air flows into the surge tank, through the various air intake pipes, and into the intake ports. Fuel injected by the injectors near the intake ports flows into and is mixed with the fresh air to create a combustible gaseous mixture taken into the engine. A breather pipe extends from the engine cylinder head and is connected to the throttle valve.

The surge tank, the air intake pipes, and the intake manifold cover forming the air intake device are generally cast from a lightweight and durable material such as an aluminum alloy. The surge tank is then firmly bolted to the engine crank case, and the intake manifold cover is firmly bolted to the cylinder head of the engine with the air intake pipes supported between the surge tank and the intake manifold cover.

Although the surge tank, the air intake pipes, and the intake manifold cover are formed as a single unit, the engine includes multiple parts, such as a crank case, a cylinder block, and a cylinder head, that must be assembled. Therefore, misalignment between the air intake device and the engine is common, causing difficulty in connecting the various air intake components to the engine. Conventionally, to avoid such conditions, the components must be manufactured and assembled with great precision, thus significantly increasing the costs associated with the devices.

Another problem associated with conventional air intake devices arises because of the complexity of manufacturing the surge tank, air intake pipes, and intake manifold cover as a single, large unit.

Thus, an outboard boat engine air intake device is needed that can be easily attached to an engine, and that further can be manufactured with less complexity than conventional devices.

SUMMARY OF INVENTION

Accordingly, the present invention is directed to an air intake device for an outboard boat engine that substantially obviates one or more of the problems due to the limitations and disadvantages of the related art.

Additional advantages of the invention will be set forth in the description which follows, and in part will be apparent from the description or may be learned by practice of the invention. The advantages of the invention may be realized and obtained by means of the combinations particularly pointed out in the appended claims.

To achieve these and other advantages and in accordance with the purpose of the invention, as embodied and broadly described, the invention includes an air intake device for a vertically oriented multi-cylinder outboard boat engine having an engine block, a crankcase, and vertically spaced fuel intake ports. The invention further includes an air intake device including a surge tank rigidly attached to the crankcase and having a plurality of vertically spaced air intake union pipes extending from the surge tank, and an intake manifold cover rigidly attached to the engine block and having a plurality of vertically spaced air intake union pipes extending from the intake manifold cover. Flexible air intake hoses are connected between the air intake union pipes extending from the surge tank and the air intake pipes extending from the intake manifold cover.

In another aspect of this invention, the internal diameter of the flexible air intake hose gradually decreases in the direction from the surge tank to the intake manifold cover. Also, the flexible air intake hose is fabricated of an external layer and an internal layer, where the external layer is harder than the internal layer.

In still another aspect of this invention, the thickness of the internal layer is greater at the ends of the air intake hose than the thickness of the external layer. Also, the thickness of the internal layer at the central portion of the air intake hose is less than that of the external layer. Further, internal notched sections are provided in the internal layer of the flexible air intake hose at the area of connection to the surge tank air intake union pipe. Still further, internal notched sections can be provided in the internal layer of the flexible air intake hose at the areas of connection to the surge tank air intake union pipe and the intake manifold cover union pipe.

In another aspect of this invention, the connection points between the flexible air intake hose and the union pipes are located under a cover that overlays the top of the engine.

It is to be understood that both the foregoing general description and the following detailed description are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate several embodiments of the invention and together with the description serve to explain the principles of the invention. In the drawings.

DETAILED DESCRIPTION OF THE PREFERRED EMBODIMENTS

Reference will now be made in detail to the present preferred embodiments of the invention, examples of which are illustrated in the accompanying drawings.

Figure 1:
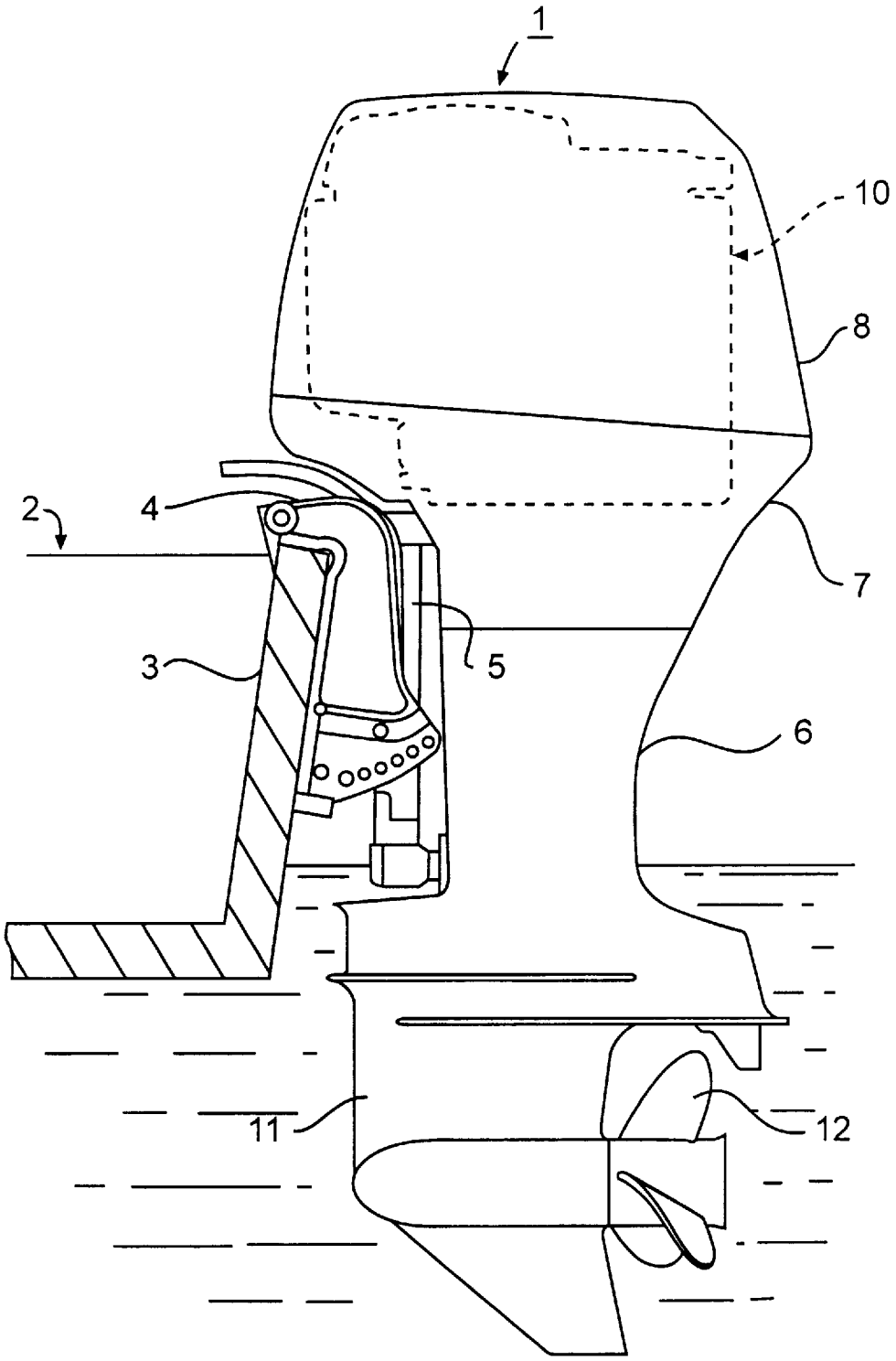
FIG. 1 is a side view of an outboard motor in which the air intake device of this invention is used.

As shown in FIG. 1, an outboard boat motor 1 is mounted on a transom 3 on the body of a boat 2 by a clamp bracket 4 so that the motor can pivot freely on a swivel shaft 5 secured to the motor 1.

A drive housing 6, which occupies the center of the outboard boat motor 1, is joined to the clamp bracket 4 by the swivel shaft 5. Located above the drive housing 6 is a two-part engine cover 7, 8 in which an engine 10 is housed. The engine 10 is housed such that the crank shaft thereof (not shown) is vertically oriented.

A gear case 11 is provided in the lower part of the drive shaft housing 6, and a propeller 12 is supported by a shaft (not shown) in the back of the gear case 11. Moreover, the propeller 12 is rotationally driven by a drive shaft that extends vertically downward from the engine 10.

Figure 2:
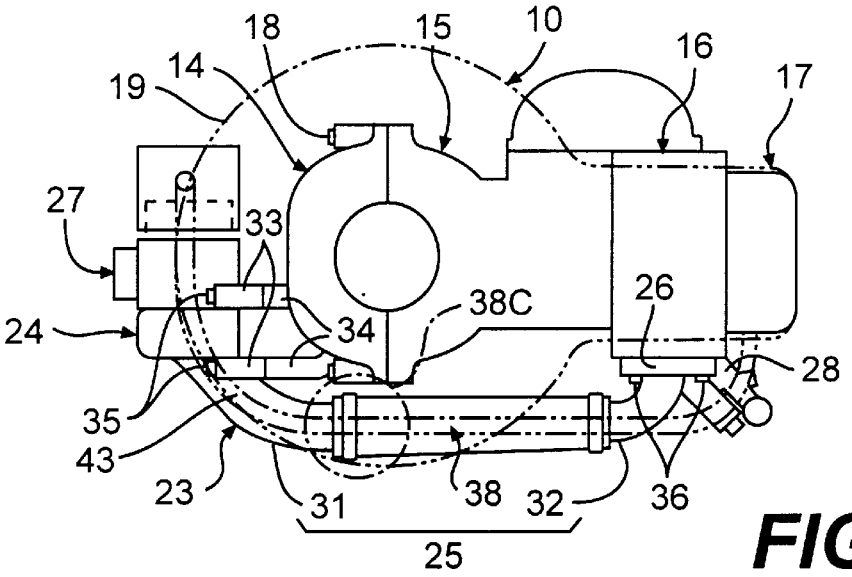
FIG. 2 is a top view of an engine in accordance with this invention.
Figure 3:
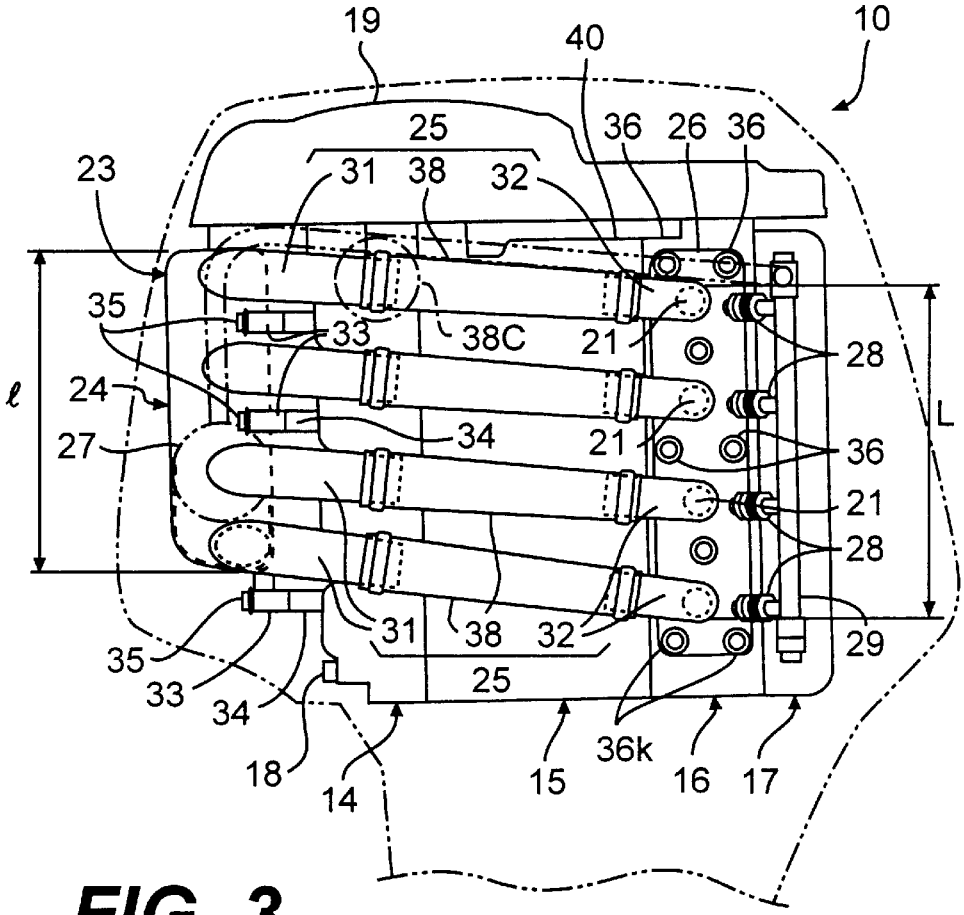
FIG. 3 is a side view of an engine in accordance with this invention.
Figure 4:
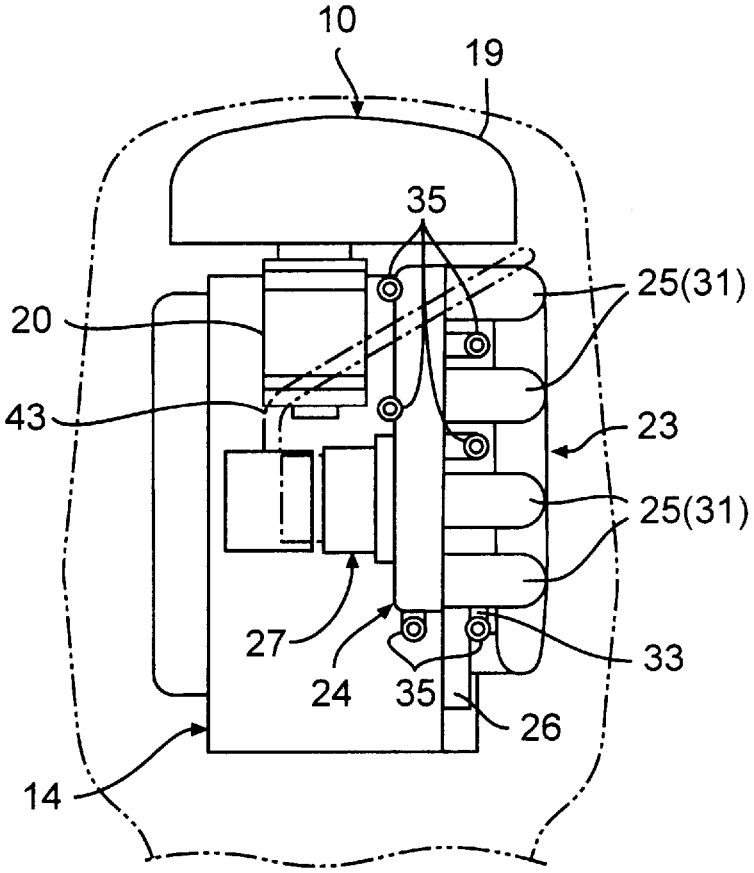
FIG. 4 is a frontal view of an engine in accordance with this invention.

As shown in FIGS. 2–4, the engine 10 is a four-cycle gasoline engine including a crank case 14 in which a crank shaft extends vertically, a cylinder block 15, a cylinder head 16, and a head cover 17 attached by bolts 18 to the crank case 14. A flywheel cover 19 overlying a flywheel (not shown) is mounted on top of the engine 10.

In accordance with the invention, an outboard boat engine air intake device is provided. The air intake device of this invention includes a surge tank 24 attached to the front of the crank case 14 to regulate the supply of combustion air to the engine. A plurality of air intake pipes 25 extend from the left side of the surge tank 24. A single throttle valve 27 controls the amount of air taken into the surge tank 24. It is preferred that the plurality of air intake pipes 25 are arranged in vertical stages to facilitate connection of the air intake pipes 25 to respective air intake ports 21 opened in the left side of the cylinder head 16.

A single intake manifold cover 26 is connected by bolts 36 to the cylinder head 16. Also, connection bushings 33 on the surge tank 24 are connected to corresponding bosses 34 on the crank case 14 by bolts 35. It is preferred that the throttle valve 27, which regulates the amount of air taken into the surge tank 24, be located on the side of the surge tank 24. A breather pipe 40, which extends from the cylinder head 16, is connected to the throttle valve 27. Also, fuel injectors 28, with an associated fuel delivery pipe 29, are mounted in the intake manifold cover 26 so they face the interior of the intake ports 21.

When the throttle valve 27 opens, fresh air flows into the surge tank 24, then through the respective air intake pipes 25, and into the intake ports 21. Fuel, injected from the fuel injectors 28 and into the intake ports 21, is blended with the fresh air to create a combustible gaseous mixture, which is then taken into the engine 10.

The surge tank 24 is rigidly connected to the crank case 14 and the intake manifold cover 26 is rigidly connected to the engine 10 such that the two are joined by the air intake pipes 25. Often misalignment between the surge tank 24 and engine 10 causes difficulty in making this connection.

In accordance with the present invention, it is preferred that the surge tank 24 have four short union pipes 31 rigidly extending from the surge tank 24 toward the engine 10, the union pipes 31 and the surge tank 24 forming a single unit. The intake manifold cover 26 and four short union pipes 32 rigidly extending from the intake manifold cover 26 toward the surge tank 24, also form a single unit.

Figure 5:
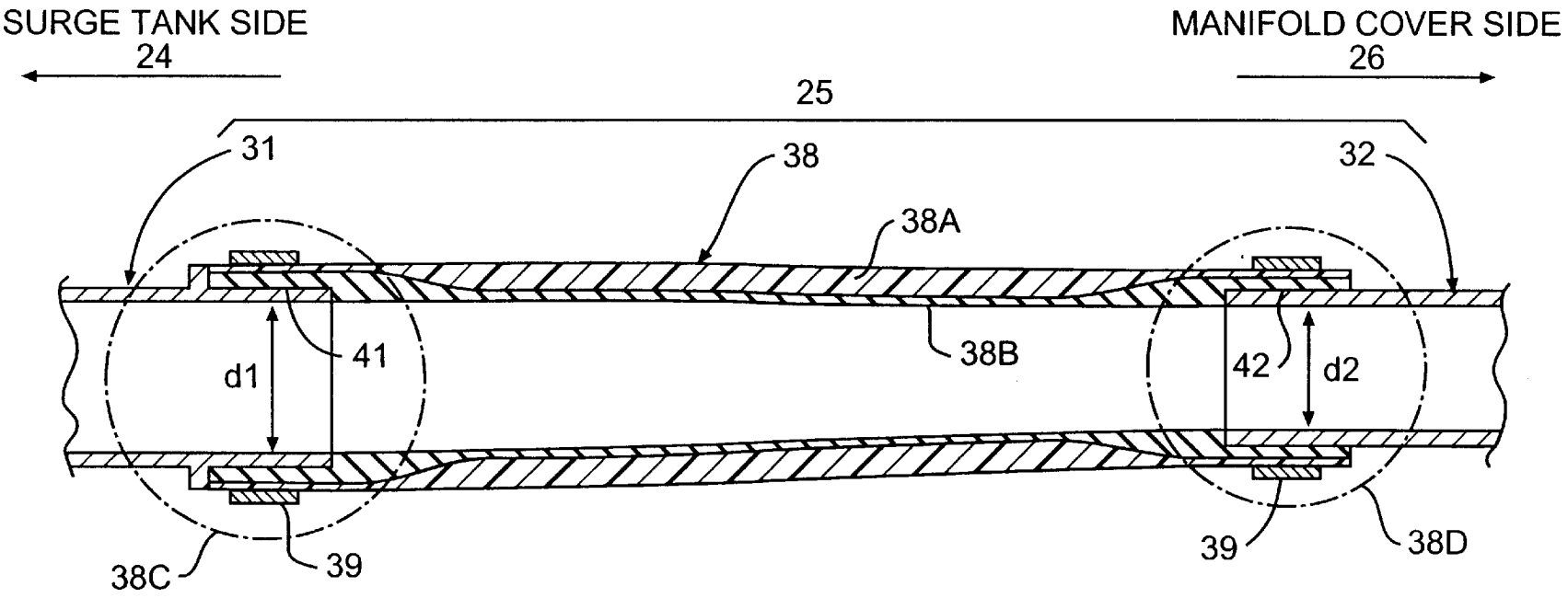
FIG. 5 is a lateral cross-section of the intake pipes taken on line V—V in FIG. 2.

In accordance with the invention, the union pipes 31 of the surge tank 24 and the union pipes 32 of the intake manifold cover 26 are connected with flexible hoses 38 as shown in FIG. 5. Clamping bands 39 are provided to secure the flexible hoses 38 to the union pipes 31, 32.

It is preferred that the hoses 38 be comprised of an outer layer 38A and an inner layer 38B. It is further preferred that the inner layer 38B be softer than the external layer 38A. For example, polypropylene (a rather hard, and very strong, synthetic resin) or the like can be used as the external layer 38A, while NBR or some other such rubber material that is softer than polypropylene and that is highly fire resistant can be used as the internal layer 38B. The softer inner layer 38B enhances the sealing between the hose 38 and the union pipes 31, 32.

It is preferable that the internal layer 38B be thicker than the external layer 38A at the ends of the hoses 38, where connection to the union pipes 31, 32 is desired, but that the external layer 38A be thicker in the central part of the hoses 38.

It is also preferred that the thickness ratios remain otherwise constant. The thickness ratios of this invention further enhance the sealing effectiveness of the hoses 38 to the union pipes 31, 32 and increase the strength of the hoses 38.

It is also preferable that the internal diameters d1 of the union pipes 31 are larger than the internal diameter d2 of the intake manifold cover union pipes 32. Likewise, the internal diameters of the hoses 38 are larger on the side of the surge tank union pipes 31 than on the side of the intake manifold cover union pipes 32. The various intake pipes 25 are thus tapered tubes with internal diameters gradually decreasing in the direction from the surge tank 24 to the intake manifold cover 26.

It is further preferable that internal notched sections 41, 42 be provided in the internal diameters d1, d2 of the hoses 38 at the connection points to the union pipes 31, 32 so that staging does not occur in the internal surface of the intake pipes at the points 38C, 38D. Such an internal notched section 41 must at least be provided in the internal diameter d1 of the end of the downstream side of the hoses 38. As shown in FIG. 5, however, it is preferred if internal notched sections 41, 42 are provided in both the upstream and downstream sides of the hoses 38.

The connection points 38C where the hoses 38 join the side of the surge tank 24 and that comprise the central part of the intake pipes 25, are located beneath the flywheel cover 19 that overlays the top of the engine 10 and are also located in the perpendicular plane of projection of flywheel cover 19.

It will be apparent to those skilled in the art that various modifications and variations can be made in the air intake device for outboard boat engine of the present invention without departing from the spirit or scope of the invention. Thus, it is intended that the present invention cover such modifications and variations of this invention provided they come within the scope of the appended claims and their equivalents.

I claim:

1. An air intake device for a vertically oriented multi-cylinder outboard boat engine having an engine block, a crankcase and vertically spaced fuel intake ports, said air intake device comprising:

a surge tank rigidly attached to said crankcase and having a plurality of vertically spaced air intake union pipes extending from said surge tank; and an intake manifold cover rigidly attached to said engine block and having a plurality of vertically spaced air intake union pipes extending from said intake manifold cover; and flexible air intake hoses connected between said air intake union pipes extending from said surge tank and said air intake union pipes extending from said intake manifold cover.

2. The outboard boat engine air intake device of claim 1 wherein the internal diameter of said flexible air intake hose gradually decreases in the direction from said surge tank to said intake manifold cover.

3. The outboard boat engine air intake device of claim 1 wherein said flexible air intake hose comprises an external layer and an internal layer, and wherein said external layer is harder than said internal layer.

4. The outboard boat engine air intake device of claim 3 wherein the thickness of said internal layer at the ends of said flexible air intake hose is greater than the thickness of said external layer.

5. The outboard boat engine air intake device of claim 3 wherein the thickness of said internal layer at the central portion of said flexible air intake hose is less than the thickness of said external layer.

6. The outboard boat engine air intake device of claim 1 wherein internal notched sections of said internal layer of said flexible air intake hose are provided at the area of connection to said surge tank air intake union pipe.

7. The outboard boat engine air intake device of claim 1 wherein internal notched sections of said internal layer of said flexible air intake hose are provided at the area of connection to said surge tank air intake union pipe and the area of connection to said intake manifold cover union pipe.

8. The outboard boat engine air intake device of claim 1 wherein the connection points between said flexible air intake hose and said union pipes are located under a cover that overlays the top of said engine.

* * * * *